US005773778A

United States Patent [19]

Arnold

[11] Patent Number: 5,773,778

[45] Date of Patent: Jun. 30, 1998

[54] MODULAR ISOLATION BLOCK FOR CIRCUIT BREAKER CONTACT ARMS

[75] Inventor: David Arnold, Chester, Conn.

[73] Assignee: General Electric Company, New York, N.Y.

[21] Appl. No.: 637,020

[22] Filed: Apr. 24, 1996

[51] Int. Cl.[6] ..... H01H 33/42; H01H 3/00

[52] U.S. Cl. ..... 218/153; 218/154; 335/185; 335/189

[58] Field of Search ..... 218/7, 8, 9, 14, 218/153, 154, 20, 21; 335/172, 185, 184, 192; 361/627; 200/304, 305, 401, 400

[56] References Cited

U.S. PATENT DOCUMENTS

| | | | |
|---|---|---|---|
| 4,672,501 | 6/1987 | Bilac et al. | 361/96 |
| 4,733,211 | 3/1988 | Castonguay et al. | 335/189 X |
| 4,764,650 | 8/1988 | Bur et al. | 218/153 X |
| 4,801,907 | 1/1989 | Kelaita et al. | 335/20 |
| 5,424,701 | 6/1995 | Castonguay et al. | 335/172 |

FOREIGN PATENT DOCUMENTS

| | | | |
|---|---|---|---|
| 2287834 | 9/1995 | United Kingdom | H01H 71/00 |

*Primary Examiner*—J. R. Scott

*Attorney, Agent, or Firm*—Richard A. Menelly; Carl B. Horton

[57] ABSTRACT

A single-sized circuit breaker electric isolation block provides both electric insulation between the circuit breaker operating mechanism as well as mechanical support to the circuit breaker contact arm assembly over a wide range of circuit breaker ampere ratings. The isolation block is formed from a plastic composition and is shaped to receive the circuit breaker operating mechanism connector link for each phase of a multi-phase circuit breaker assembly. The positional relationship on the block accommodates the connector links used with a wide range of circuit breaker ampere ratings.

10 Claims, 6 Drawing Sheets

10

MODULAR ISOLATION BLOCK FOR CIRCUIT BREAKER CONTACT ARMS

BACKGROUND OF THE INVENTION

U.S. Pat. No. 4,764,650 entitled "Molded Case Circuit Breaker with Removable Arc Chutes and Disengageable Transmission System Between the Operating Mechanism and the Poles" describes an insulating support that is attached to an internal circuit breaker partition wall and supports the circuit breaker movable contact arms. The plastic insulating support not only electrically isolates the circuit breaker operating mechanism from the circuit breaker contact arms, but also supports the contact arms. In order for the plastic support to have long-term functionality, the contact arm assembly must be arranged such that the plastic does not experience excessive thermal aging. This is often accomplished by increasing the physical size of the plastic support in order to lower the stress-to-strength ratio for circuit breakers with higher ampere ratings to achieve lower power dissipation. For industrial rated circuit breakers with higher ampere ratings and higher power dissipation, a corresponding increase in the size of the circuit breaker operating mechanism would be in excess of the circuit breaker overall size restraints.

British Patent No. 2,287,834 entitled "Isolation Housing for Circuit Breaker" describes an isolation housing used within a low ampere industrial rated circuit breaker in the form of a fixedly attached electrically insulating link. It is advantageous, in higher rated circuit breakers, to separate the function of mechanical support from the function of electrical isolation between the operating mechanism and contact arm, without having to increase the size of the plastic isolation housing, which serves to electrically isolate the contact arm from the operating mechanism. Through such functional optimization, a compact design is achieved. Utilization of a similar design in higher ampere industrial rated circuit breakers, however, also requires a larger operating mechanism, in excess of the circuit breaker size constraints. It would be beneficial to employ compact phase-to-mechanism electric isolation within higher ampere industrial rated circuit breakers without requiring a larger operating mechanism.

One purpose of the invention is to separate the functions of mechanical support and electrical isolation from the circuit breaker contact arm isolation block without having to increase the size of either the plastic isolation housing or the circuit breaker operating mechanism.

SUMMARY OF THE INVENTION

A single-sized circuit breaker electric isolation block provides both electric insulation between the circuit breaker operating mechanism as well as mechanical support to the circuit breaker contact arm assembly over a wide range of circuit breaker ampere ratings. The isolation block is formed from a plastic composition and is shaped to receive the circuit breaker operating mechanism connector link for each phase of a multi-phase circuit breaker assembly. The positional relationship on the block accommodates the connector links used with a wide range of circuit breaker ampere ratings.

DESCRIPTION OF THE PREFERRED EMBODIMENT

Figure 1:
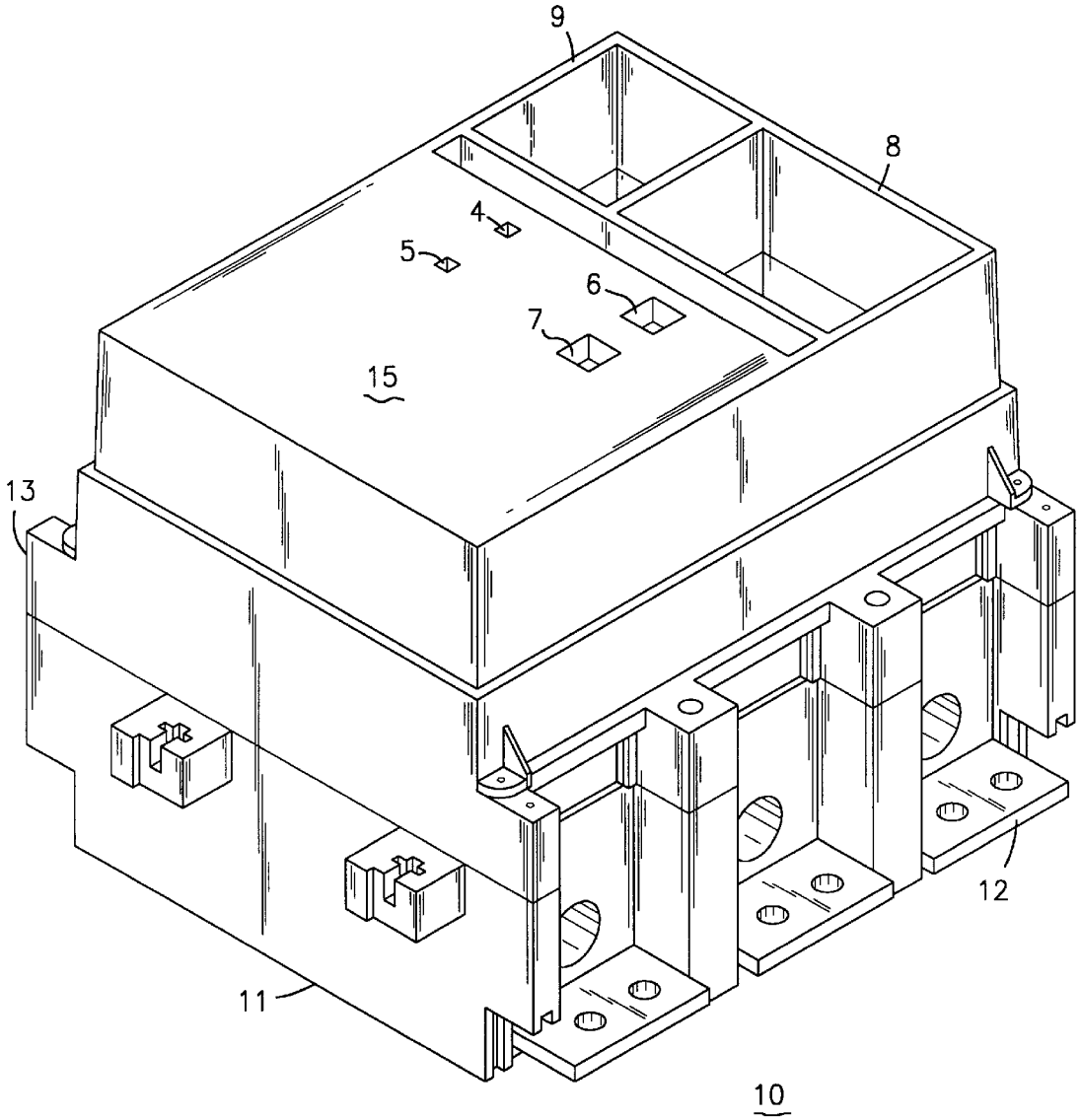
FIG. 1 is a top perspective view of a circuit breaker operating mechanism employing the contact arm isolation block according to the invention.
Figure 2:
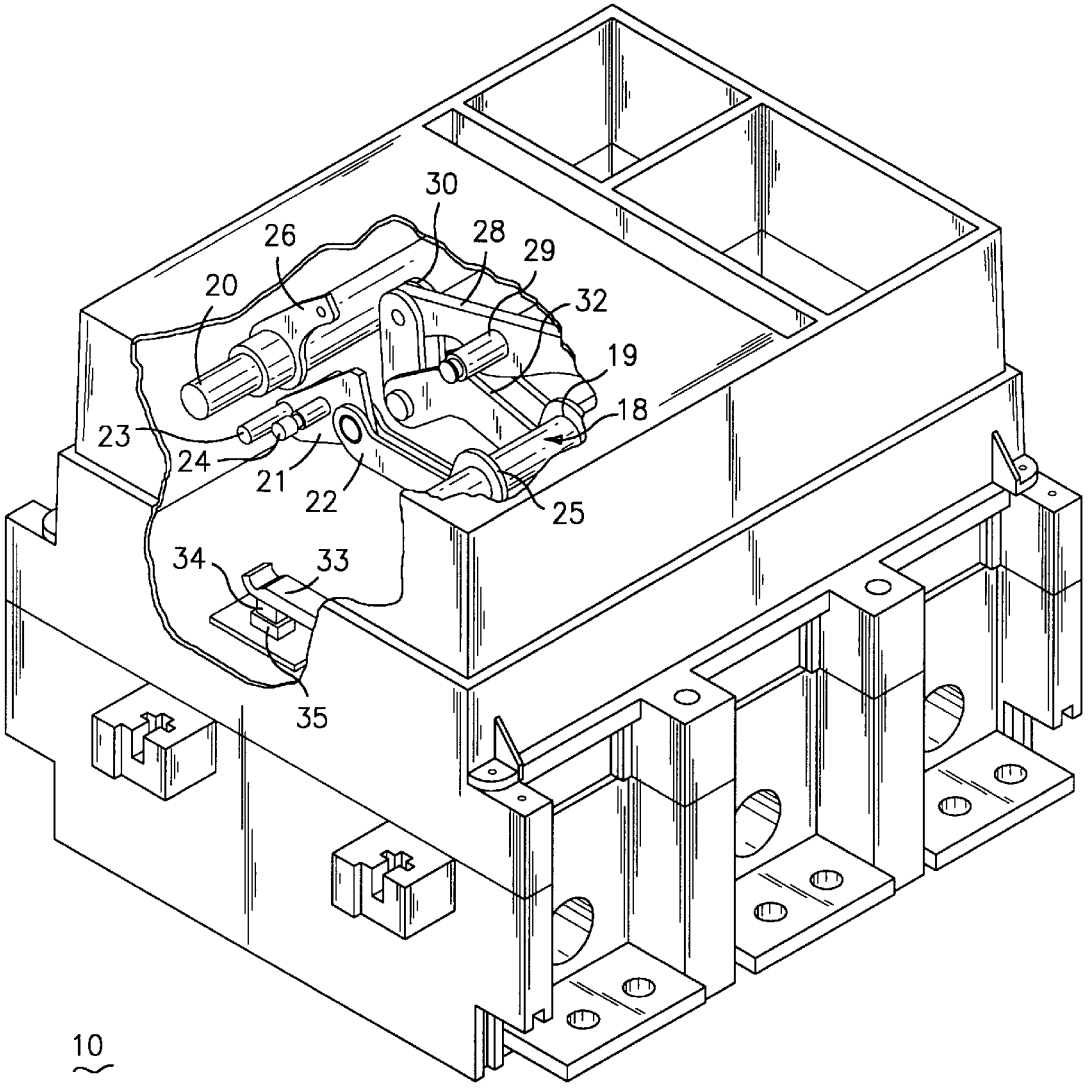
FIG. 2 is a top perspective view of the circuit breaker of FIG. 1 with a portion of the cover removed to depict the circuit breaker operating mechanism.

The high ampere-rated circuit breaker 10 shown in FIG. 1 is capable of transferring several thousand amperes quiescent circuit current at several hundred volts potential without overheating. The circuit breaker consists of an electrically insulated base 11 to which an intermediate cover 13 of similar insulative material is attached prior to attaching the top cover 15, also consisting of an electrically-insulative material. Electrical connection with the interior current-carrying components is made by load terminal straps 12 extending from one side of the base and line terminal straps (not shown) extending from the opposite side thereof. The interior components are controlled by an electronic trip unit contained within a recess 8 on the top surface of the top cover 15. Although not shown herein, the trip unit is similar to that described within U.S. Pat. No. 4,672,501 entitled "Circuit Breaker and Protective Relay Unit" and interacts further with an accessory contained within the accessory recess 9 to provide a range of protection and control functions such as described, for example within U.S. Pat. No. 4,801,907 entitled "Undervoltage Release Accessory for a Circuit Breaker Interior". ON and OFF buttons 6, 7 and ON and OFF indicators 4, 5 accessible from the top cover allow manual operation of the circuit breaker operating mechanism 18 to separate the circuit breaker movable and fixed contacts 34, 35 as best seen by now referring to FIG. 2.

Figure 3:
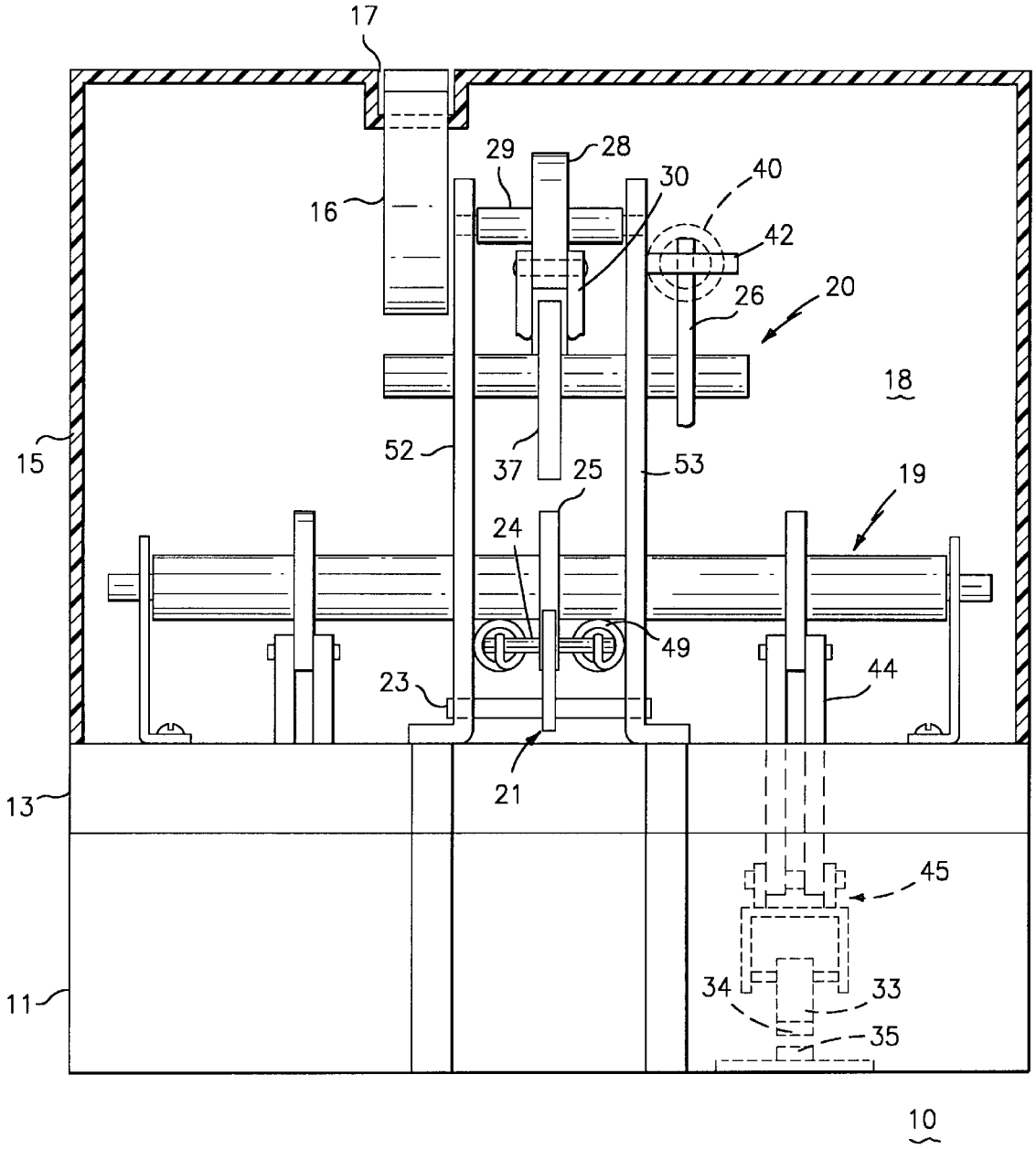
FIG. 3 is an end view of the circuit breaker of FIG. 2 with part of the cover removed to show the positional relationship of the operating mechanism components.

The closing shaft 20 is depicted relative to the drive shaft 19 with the various drive and closing springs removed for purposes of clarity and to depict the positional relationship between the two shafts as they interact to control the position of the movable contact arm 33 and the moveable contact 34. The cradle 28 rotates about the cradle pivot 29 and interacts with both the drive shaft and the closing shafts by means of the cradle links 30 and the drive shaft link 32. As described below in greater detail, the drive shaft 19 connects with the opening link 22 by attachment to the crank 25 at one end and to the interface cam 21 at the opposite end. The pins 23, 24 on the interface cam serve as a pivot pin and as a spring support pin. The crank 26 on the closing shaft 20 allows for the attachment of a closing spring 40, between the crank and the post 42 as shown in the operating mechanism 18 within the circuit breaker 10 depicted in FIG. 3.

The operating handle 16 extends within the recess 17 along one of the sideframes 52, 53 and interacts with the closing shaft 20 which extends between the sideframes. The cradle 28 is supported on the cradle pivot 29 and interconnects with the closing cam 37 on the closing shaft 20 by means of the cradle links 30. The crank 26 extending from the closing shaft 20 supports the powerful closing spring 40 to rotate the drive shaft 19 and move the contact arm drive link 44, contact arm carrier assembly 45 and contact arm 33 into the CLOSED condition with the movable contact 34 in abutment with the fixed contact 35. The interface cam 21 includes the spring support pin 24 that positions and supports opening springs 49 to rotate the interface cam 21 about the pivot pin 23 to rotate the drive shaft 19 and lift the contact arm drive link 44, contact arm carrier assembly 45 and contact arm 33 to drive the moveable contact 34 away from the fixed contact 35. Although only one pair of moveable and fixed contacts are depicted, there is a similar pair of such contacts for each circuit breaker pole contained within the circuit breaker case 11. The contacts and other current-carrying components are contained within the circuit breaker case and are insulated from the operating mechanism components within the top cover 15 by means of the electrically-insulating intermediate cover 13.

Figure 4:
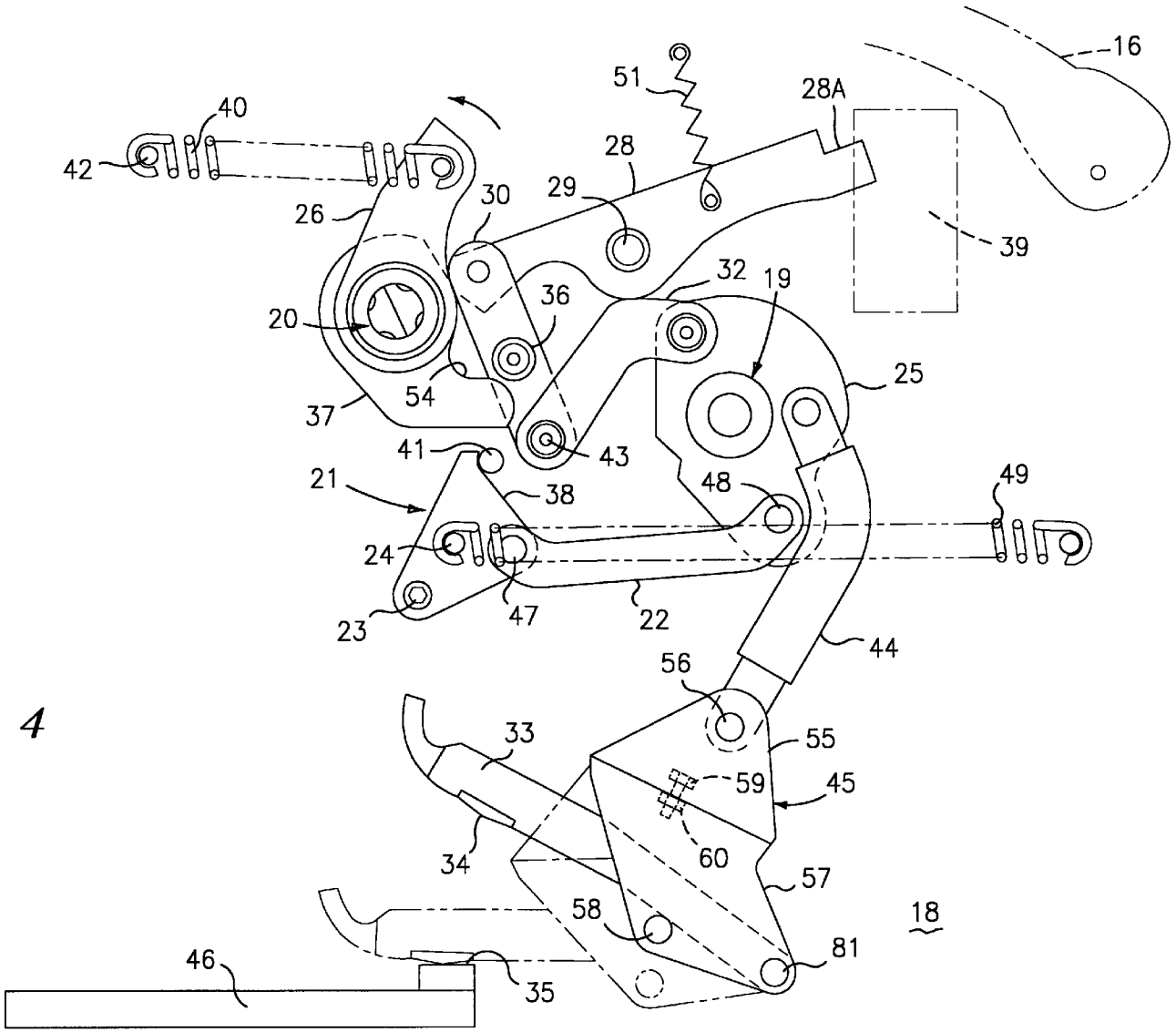
FIG. 4 is an enlarged side plan view of the operating mechanism of FIG. 2 with the circuit breaker contacts in the OPEN and LATCHED condition.

The operating mechanism 18 is described in U.S. Pat. No. 5,424,701 entitled "Operating Mechanism for High Ampere-Rated Circuit Breakers" and is shown in FIG. 4. The fixed contact 35 on the contact support 46 and the moveable contact 34 on the moveable contact arm 33 are in their OPEN condition. The operating handle 16 and latch assembly 39 are both depicted in phantom and interact with the cradle 28 such that the cradle end 28A is retained by the latch assembly keeping the cradle from rotation about the cradle pivot 29 when the closing spring 40 is fully extended. The camming surface 54 on the closing cam 37 carried by the closing shaft 20 is away from the closing roller 36 carried by the cradle link 30. The drive shaft 19 which connects with the contact arm carrier assembly 45 by means of the contact arm drive link 44 and crank 25 on the drive shaft and with the cradle link 30 by means of the drive shaft link 32 and connecting pin 43 moves the contact arm carrier and attached contact arm 33 between its OPEN and CLOSED positions. The interface cam 21, supported by means of the pivot pin 23, interacts with the drive shaft 19 by means of the opening link 22, which is connected to the interface cam and the crank 25 on the drive shaft 19 by means of the pins 47,48 to accurately control the operation of the crankshaft. With the cradle held in position by the cradle return spring 51 and latch assembly 39, and with the interface cam 21 held in the position depicted in FIG. 4 by means of the engagement of the end of the camming surface 38 on the interface cam 21 with the stop pin 41. In this position, the opening spring 49 extending from the pin 24 on the interface cam 21 restrains the drive shaft 19 from rotation under the urgence of the powerful closing spring 40 and thereby maintains the moveable contact arm 33 in the OPEN position. When it is desired to move the moveable contact 34 to the CLOSED position, the interface cam 21 is displaced away from the stop pin 41 which allows the drive shaft 19 connected with the opening link 22 and the crank 25 to rotate in the clockwise direction driving the contact arm drive link 44 and attached contact arm carrier assembly 45 in the downward direction forcing the moveable contact arm 33 and attached moveable contact 34 into abutment with the fixed contact 35 as shown in phantom.

To prevent electrical connection between the metal contact arm drive link 44 and the metal contact arm carrier 57, an isolation block 55 is interposed by connection between the contact arm carrier by means of bolts 59 and nuts 60 within the contact arm carrier assembly 45. The connection between the isolation block 55 and the contact arm drive link 44 is made by means of a connector pin 56 inserted within the end of the contact arm drive link. The function of the isolation block 55 is similar to that described within the aforementioned British Patent No. 2,287,834, wherein the mechanical support for the contact arm 33 is provided by the metal contact arm carrier 57 and the electrical isolation is provided by the electrically insulative material used to form the isolation block 55. The contact arm 33 is attached to the contact arm carrier 57 by means of the pivot pin 81 and carrier pin 58, as indicated.

Figure 6:
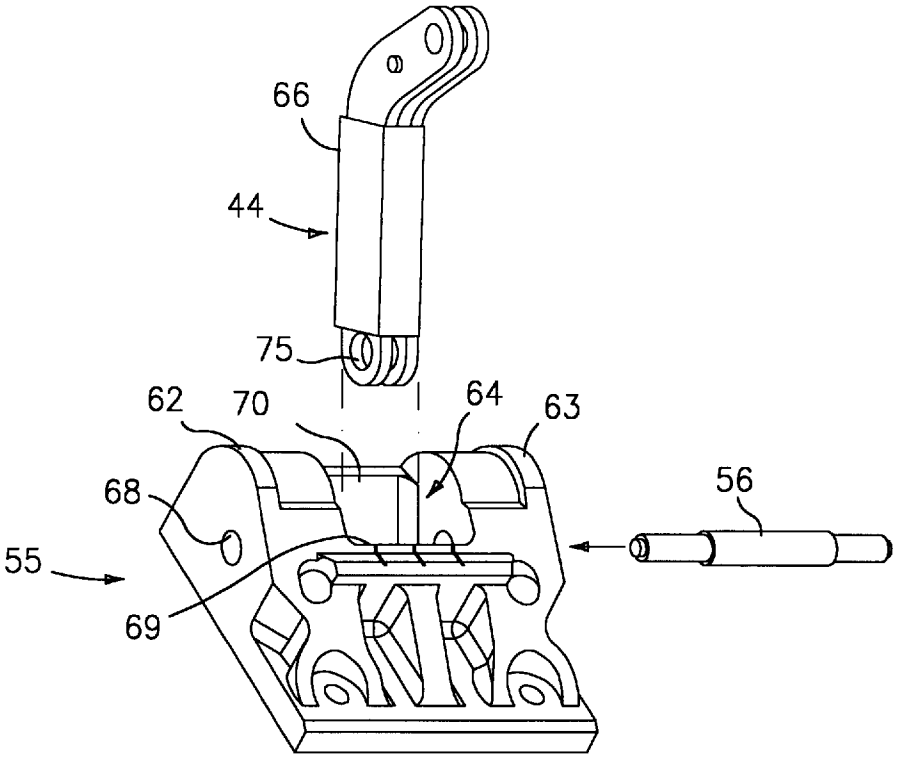
FIGS. 5 and 6 are enlarged top perspective views of the contact arm isolation block of FIG. 4.
Figure 5:
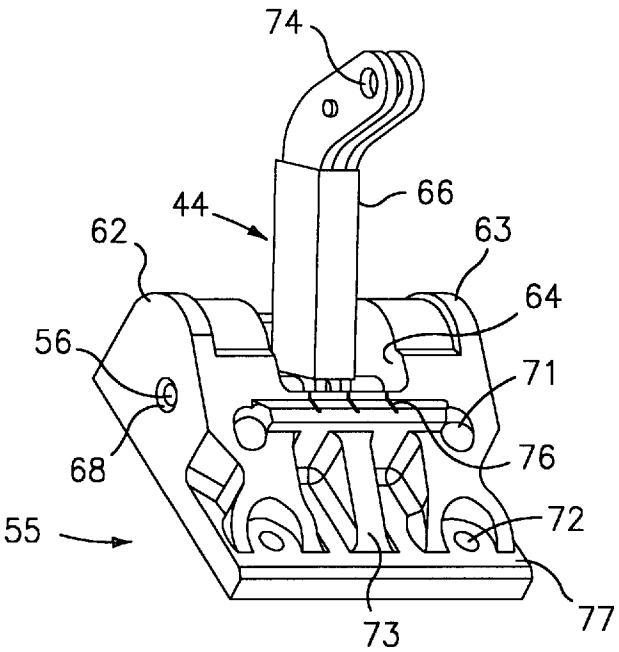

In accordance with the invention, the isolation block 55 is shown in FIGS. 5 and 6 to depict the attachment between the connector pin 56, the bottom apertures 75 within the contact arm drive link 44 and the thru-holes 68 within the opposing side pieces 62, 63 in the isolation block. To provide additional electrical isolation, an electrically insulative sleeve 66 is arranged on the contact arm drive link 44. Openings 71, 72 allow for the attachment of the isolation block 55 to the contact arm carrier 57 by means of the bolts 59 as shown earlier in FIG. 4 and connection to the contact arm drive link 44 is made by means of the apertures 74. The isolation block 55 further includes front and rear walls 69, 70 that define a cavity 64 with indicia stripes 76 formed in the front wall and with a support ridge 73 integrally-formed within the isolation block and extending from the bottom 77 of the block to the top of the front wall 69.

Figure 7:
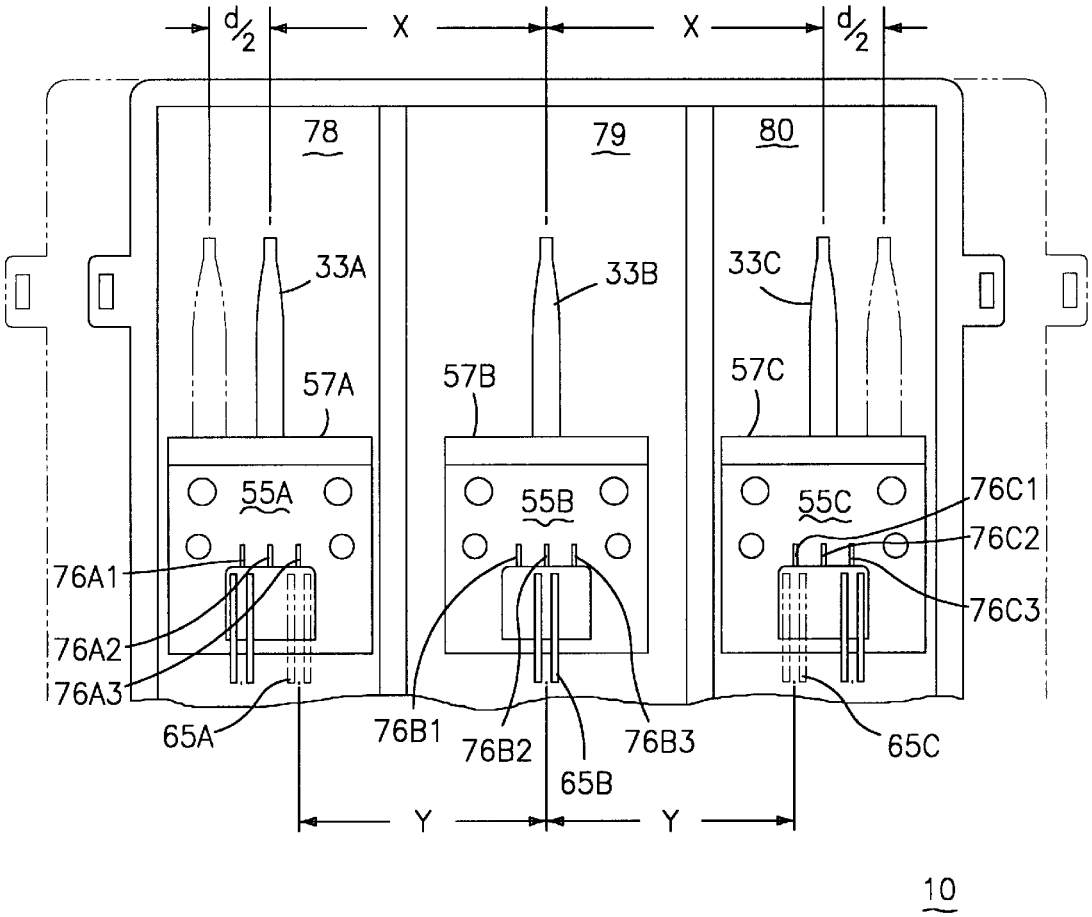
FIG. 7 is a top plan view of the circuit breaker case of FIG. 1 with the contact arm isolation blocks attached thereto.

The circuit breaker 10 is depicted in FIG. 7 with the cover removed and a part of the intermediate cover 13 broken away to show the separate compartments 78, 79, 80 housing the separate three phases within the circuit breaker case 11. The compartments are separated by means of the inner walls 11A and 11B to prevent electrical interaction between the separate phases when connected to the three phases of an electrical distribution system. Separate isolation blocks 55A–55C are attached to separate contact carriers 57A–57C for the individual contact arms 33A–33C respectively. The use of a single isolation block over a wide range of circuit breaker ampere ratings is described as follows. The spacing X between the individual contact carriers is determined by the circuit breaker ampere rating. Accordingly, the corresponding link connectors 65A–65C are positioned to provide the requisite over-surface clearance spacing Y by reference to the indicia 76A1, 76B2, 76C3 for the A B and C phases. For higher ampere ratings, the spacing X between the individual contact carriers is increased by a distance d requiring a wider base, as indicated in phantom, to provide for the increased over-surface clearance. Rather than using larger operating mechanism components and larger isolation blocks, the corresponding link connectors 65A–65C are connected with the corresponding contact arm carriers 57A–57C by reference to the indicia 76A1–76A3, 76B1–76B3 and 76C1–76C3.

An isolation block for electrically isolating the current carrying components of an industrial rated circuit breaker from the mechanical operating components has herein been described. Spacing between the contact arm carriers is provided within the isolation block to allow standard isolation blocks and standard operating mechanism components to be employed over a wide range of circuit breaker ampere ratings.

I claim:

1. A circuit breaker contact arm isolation block comprising:

a molded plastic support;

means on a bottom of said support for connecting with a circuit breaker contact arm assembly;

a pair of opposing side pieces integral with said support and upstanding from said bottom, said side pieces defining a recess therebetween for receiving one end of a first circuit breaker link connector;

said recess further defining opposing front and rear walls integral with said support;

said recess defines a first location between said side pieces for supporting a first circuit breaker link associated with a first circuit breaker having a first ampere rating and a second location between said side pieces for supporting a second circuit breaker link associated with a second circuit breaker having a second ampere rating, said first ampere rating being greater than said second ampere rating.

2. The circuit breaker contact arm isolation block of claim 1 wherein said recess defines a first location between said side pieces for supporting a first circuit breaker link associated with a circuit breaker having a first ampere rating and a second location between said side pieces for supporting a second circuit breaker link associated with a circuit breaker having a second ampere rating, said first ampere rating being greater than said second ampere rating.

3. The circuit breaker contact arm isolation block of claim 1 wherein said circuit breaker link connector is attached to a circuit breaker operating mechanism.

4. The circuit breaker contact arm isolation block of claim 1 including indicia on said rear walls providing positional reference for a first and a second circuit breaker link connector.

5. The circuit breaker contact arm isolation block of claim 1 including an electrical insulation sleeve on said first circuit breaker connector link.

6. A circuit breaker having an adjustable contact arm block assembly comprising:

an electrically-insulative circuit breaker enclosure;

a pair of contacts within said enclosure for separation upon occurrence of an overload condition within an associated electric circuit, one of said contacts being attached to a contact arm assembly;

an operating mechanism arranged for separating said contact to interrupt said electric circuit;

a contact arm isolation block comprising:

a molded plastic support;

means on a bottom of said support for connecting with said contact arm assembly;

a pair of opposing side pieces integral with said support and upstanding from said bottom, said side pieces defining a recess therebetween for receiving one end of a link connector;

said recess further defining opposing front and rear walls integral with said support; and a connector pin extending through said side pieces and inserted within said one end of said link connector allowing connection between said link connector and said front and rear walls.

7. A circuit breaker having an adjustable contact arm block assembly comprising:

an electrically-insulative circuit breaker enclosure;

a pair of contacts within said enclosure for separation upon occurrence of an overload condition within an associated electric circuit, one of said contacts being attached to a contact arm assembly;

an operating mechanism arranged for separating one of said contacts to interrupt said electric circuit;

a contact arm isolation block comprising:

a molded plastic support;

means on a bottom of said support for connecting with said contact arm assembly;

a pair of opposing side pieces integral with said support and upstanding from said bottom, said side pieces defining a first recess therebetween for supporting a first circuit breaker link connect or associated with a first circuit breaker having a first ampere rating and a second recess between said side pieces for supporting a second circuit breaker link connect or associated with a second circuit breaker having a second ampere rating, said first ampere rating being greater than said second ampere rating.

8. The circuit breaker of claim 7 wherein said first circuit breaker link connector and said second circuit breaker link connector are attached to a circuit breaker operating mechanism.

9. The circuit breaker of claim 7 including indicia on said support providing positional reference for said first and said second circuit breaker link connectors.

10. The circuit breaker of claim 7 including an electrical insulation sleeve on said first circuit breaker link connector.

* * * * *